US010118310B2

(12) United States Patent
Xin

(10) Patent No.: US 10,118,310 B2
(45) Date of Patent: Nov. 6, 2018

(54) FOLDABLE LOG SPLITTER

(71) Applicant: Jiashan Superpower Tools Co., LTD, Jiashan, Zhejiang Province OT (CN)

(72) Inventor: Lu Yu Xin, Jiashan (CN)

(73) Assignee: Jiashan Superpower Tools Co., Ltd., Jiashan (CN)

( * ) Notice: Subject to any disclaimer, the term of this patent is extended or adjusted under 35 U.S.C. 154(b) by 210 days.

(21) Appl. No.: 15/343,863

(22) Filed: Nov. 4, 2016

(65) Prior Publication Data

US 2018/0126582 A1 May 10, 2018

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 6,749,178 | B1 | 6/2004 | Loughner | |
| 9,381,668 | B2 * | 7/2016 | Banjo | B27L 7/00 |
| 2016/0257023 | A1 * | 9/2016 | Bowman | B27L 7/00 |

* cited by examiner

*Primary Examiner* — Matthew G Katcoff
(74) *Attorney, Agent, or Firm* — David J. Pitman; Fulwider Patton LLP

(57) ABSTRACT

A method of preparing a log splitter comprising a first beam supporting a moveable blade configured for splitting logs and a second beam extending between two wheels, the method comprising: elevating the first beam in relation to the second beam while the first beam is connected to the second beam by a rigid element that is pin jointed at a first end to the first beam and at a second end to the second beam; rotating the first beam horizontally about a vertical connection until the first beam is oriented perpendicular to the second beam; and attaching a tow bar beneath the first beam and parallel with the first beam.

4 Claims, 16 Drawing Sheets

FOLDABLE LOG SPLITTER

BACKGROUND

Mechanical log splitters are well known in the art. These are typically driven by a power source such as an internal combustion engine, which drives a blade against a foot when a log is placed between the blade and foot. Many log splitters are now sold as being mounted on a set of wheels and having a tow hitch to towing the device from one location to another. However, the marketing and distribution of such log splitters is complicated by the fact that such devices are frequently shipped over great distances, inside crates or free standing. It has become increasingly difficult and expensive to ship the devices in this manner. Where the devices are packed in crates, the shape of the device requires an extremely large crate. Where the cost of shipping is based on volume rather than weight, the cost may be prohibitively high considering the amount of free space inside the crate. Where the devices are shipped without packing, but free standing, it becomes extremely difficult, if not impossible, to stack the devices one on top of the other. A further problem that arises is that log splitters are also sold in a disassembled state in order to address the foregoing. These are packed in wooden crates, and are shipped in a relatively compact condition. However, a major problem that arises with such shipments is that the distributor or end user is obliged to assemble all the various components before the unit can be sold (if assembled by the distributor) or by the end user (where not assembled by the distributor). Such process can be extremely complex, and time consuming. It can result in the final product not working properly where pressure hoses and the like are not assembled correctly. This may necessitate the end user to return to the store with the unit for consultation with a technical expert. Or, it may necessitate a technical expert to travel to the end user to attend to the problem. These are considerable problems and disadvantages.

Accordingly, there is a need in the art for a system and method for packing and unpacking log splitters in a cost effective manner, yet in a manner which does not present problems of assembly down the line. The present invention addresses these and other problems.

SUMMARY OF THE INVENTION

With reference to the drawings, an invention is described here that addresses issues in the prior art. In some embodiments, the invention is a log splitter comprising a first beam supporting a moveable blade configured for splitting logs; a second beam is included, extending horizontally between two wheels. A connector is provided that connects the first beam to the second beam. The connector comprises: an upper pressure plate operably connected to the first beam; a lower pressure plate operably connected to the second beam; a vertical pin passing through a hole in one of the upper pressure plate or lower pressure plate, the upper pressure plate being rotatable about the pin while being in contact with the lower pressure plate. At least one shoulder plate is included being rotatably connected about a first axle to the upper pressure plate, and being further rotatably connected about a second axle to the first beam. In this configuration, the first beam is rotatable horizontally about the vertical pin between a first position being horizontal and parallel with the second beam, and a second position being horizontal and perpendicular to the second beam. The first beam is moveable upwards, while connected via the shoulder plate to the second beam, from the second position which is a first distance from the second beam, to a third position being horizontal and a second distance from the second beam, the second distance being greater than the first distance. The first beam is vertically rotatable about the second axle between the third position and a fourth position being vertically oriented and perpendicular to the second beam. In some embodiments, the upper pressure plate and lower pressure plate each define openings for a receiving a securing bolt for preventing horizontal rotation of the upper pressure plate in relation to the lower pressure plate. In some embodiments the shoulder plate and the upper pressure plate each define openings for receiving a securing bolt for preventing vertical rotation of the shoulder plate in relation to the upper pressure plate. In yet further embodiments, a tow bar is included, wherein the shoulder plate and the tow bar each define at least one opening, wherein a bolt is inserted in each opening for connecting the tow bar to the shoulder plate.

In another aspect, the invention is a method of preparing a log splitter comprising a first beam supporting a moveable blade configured for splitting logs, and a second beam extending between two wheels. The method comprises elevating the first beam in relation to the second beam while the first beam is connected to the second beam by a rigid element that is pin jointed at a first end to the first beam and pin jointed at a second end to the second beam. The first beam is rotate horizontally about a vertical pin from a first position parallel with the second beam until the first beam is oriented in a second position perpendicular to the second beam; and a tow bar is attached beneath the first beam and parallel with the first beam. In some embodiments, the invention includes, after rotating the first beam horizontally, rotating the first beam vertically into a vertical orientation. In yet further embodiments, attaching a tow bar includes attaching the tow bar to the rigid element while the first beam is in the vertical orientation. In other embodiments, the invention includes attaching the first beam to the tow bar, and yet further, attaching the first beam to the tow bar includes using a spring loaded bolt.

Thus, the present invention, as better understood by reading in conjunction with the figures and the detailed description, is adapted for being readily packed in a packing crate, but to be assembled outside the packing crate with a minimum of technical effort. Only a few bolts need to be inserted, but the pressure pipes and other mechanical parts are all pre-connected prior to shipment, and do not need further attention by the distributor of by the end user before the log splitter is fired up and used for its intended purpose.

DETAILED DESCRIPTION OF THE PREFERRED EMBODIMENTS

As better understood with reference to the figures, embodiments are here described that have features of the invention.

Figure 1:
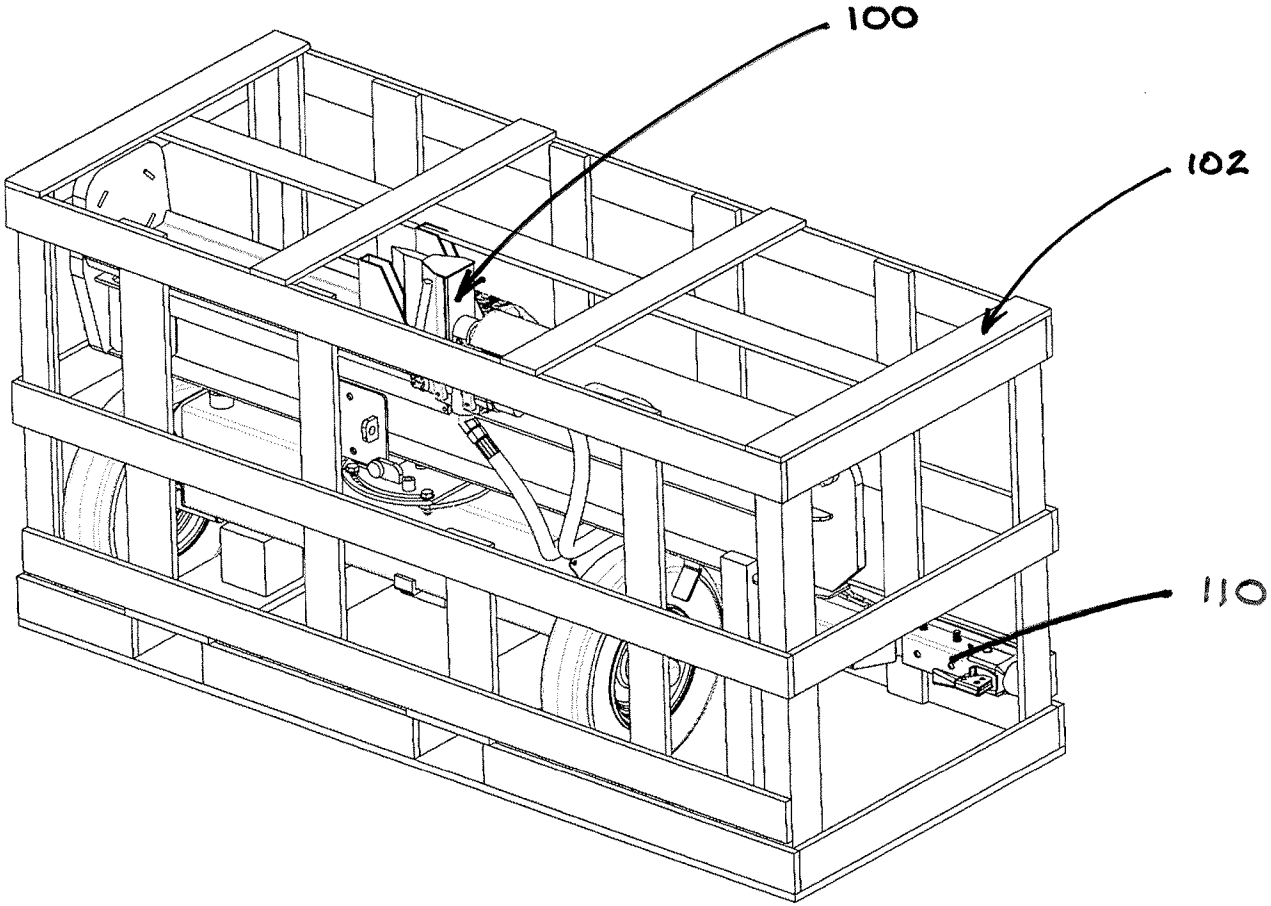
FIG. 1 is a perspective view of a log splitter in a first folded condition, while packed in a crate for shipping.

FIG. 1 exemplifies a log splitter 100 having features of the invention, shown in a folded condition, and efficiently packed inside a crate 102 for shipment. A tow hitch 110 is shown detached from the splitter, and packed separately inside the crate.

Figure 2:
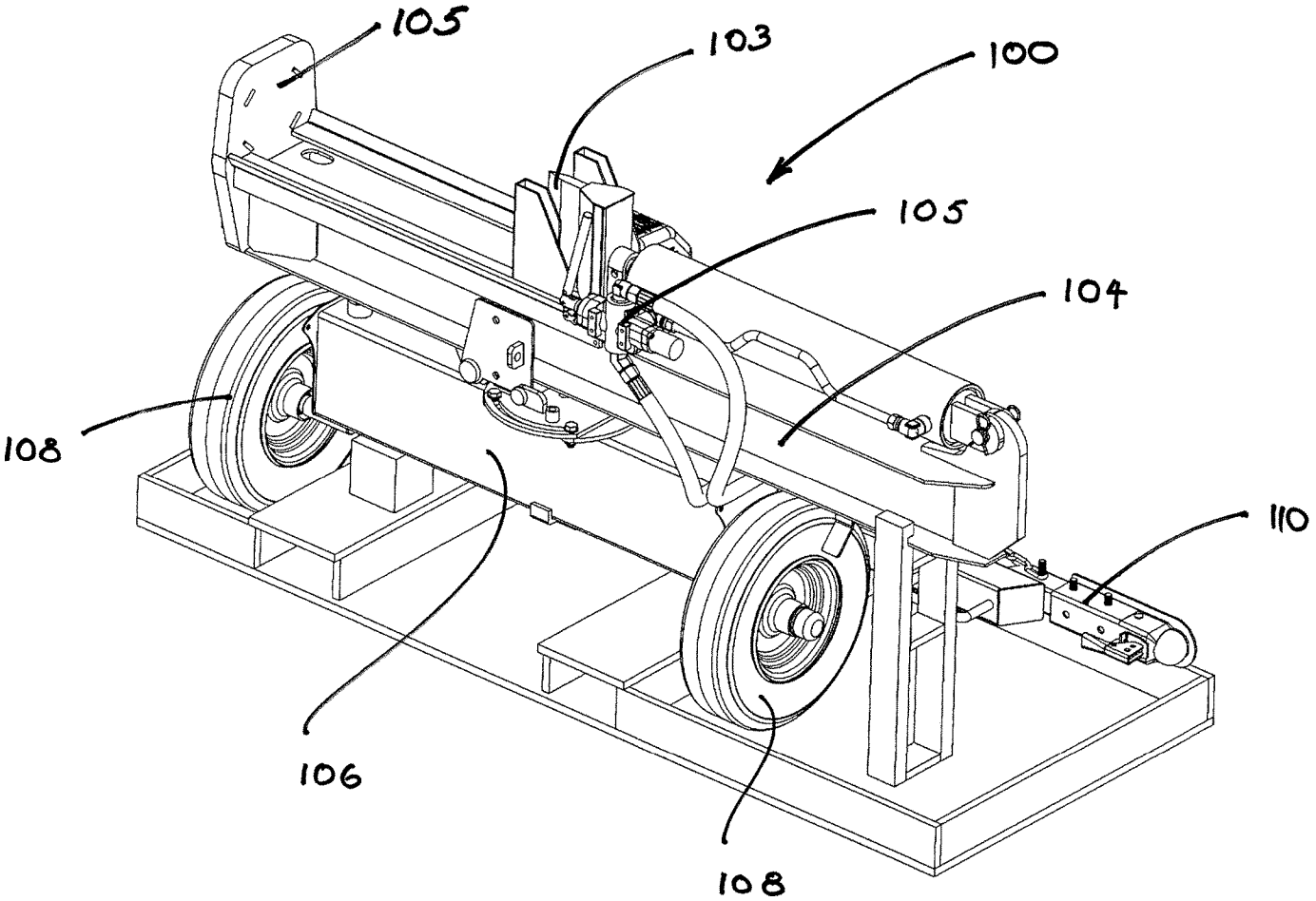
FIG. 2 is the log splitter of FIG. 1, with an upper portion of the crate removed.

FIG. 2 exemplifies the log splitter 100 after an upper portion of the crate has been removed. As shown, the splitter includes a blade 103 configured to be moved under force towards a foot 105 according to known means, and whereby a wooden log (not shown), when placed between the blade and the foot will be split. The blade and foot are mounted on a first beam 104. The splitter includes two wheels 108 which are interconnected by an axle that is covered by a second beam 106. (Alternatively, where not covered by any structure, the axle itself may be considered to be a beam for purposes of the present invention, in other words, an elongate structure spanning between the wheels.) In the condition of the splitter shown, which is for packing, the first beam 104 is oriented parallel with the second beam 106, and is lowered to be adjacent the second beam and connected thereto by a connector. A tow hitch 110 is shown, still detached from the splitter. Significantly, the log splitter in this condition includes all the mechanical hoses, pipes, gas lines 105, and engine 107, preassembled onto the first beam and the second beam. No further assembly of these items will be required during the assembly operation that takes place after the log splitter 100 is removed from the crate 102. As will be appreciated, this is a considerable advantage to the end user who consequently will avoid having to undertake the highly complex task of assembly in this regard.

Figure 3:
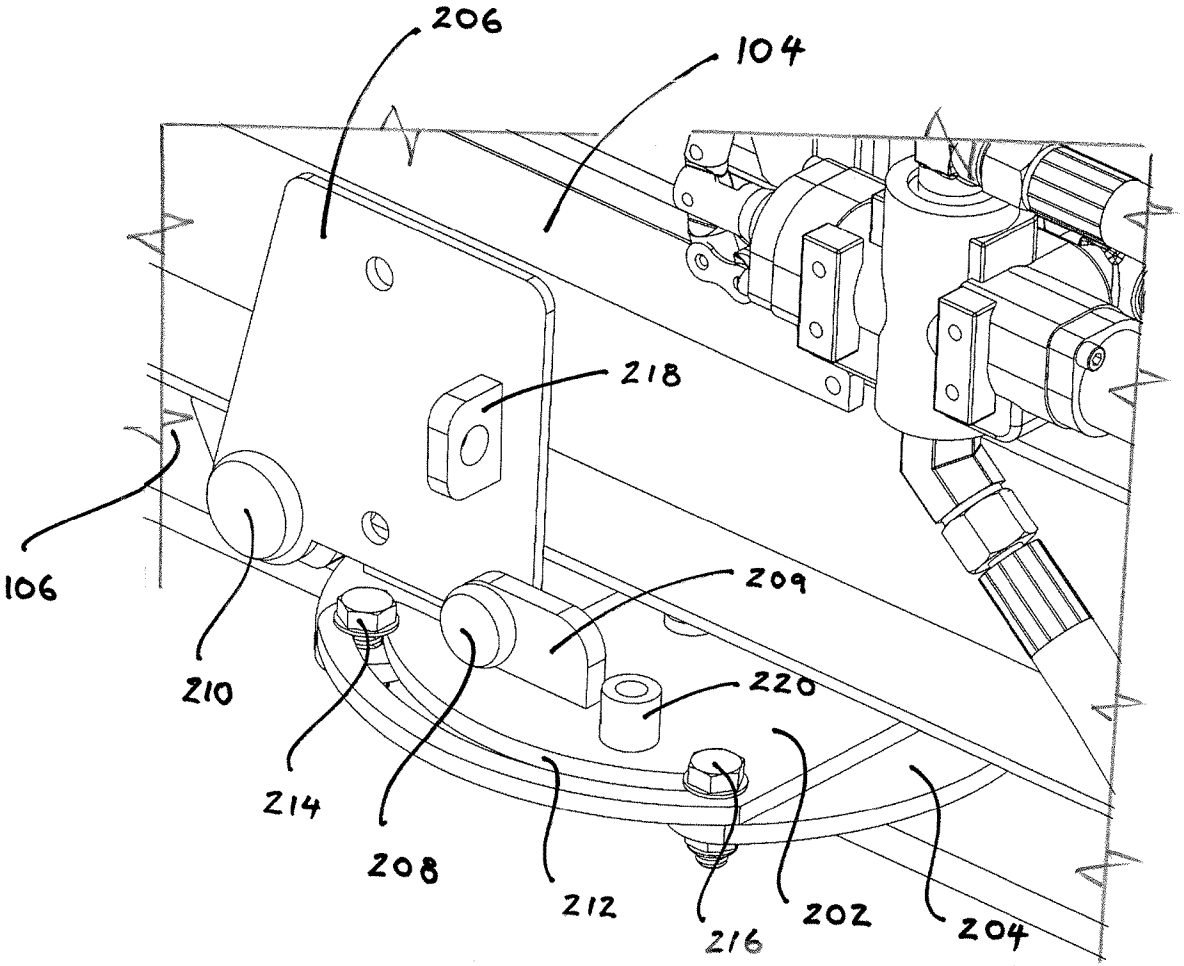
FIG. 3 is a detail view of a connector shown in FIG. 2.
Figure 11:
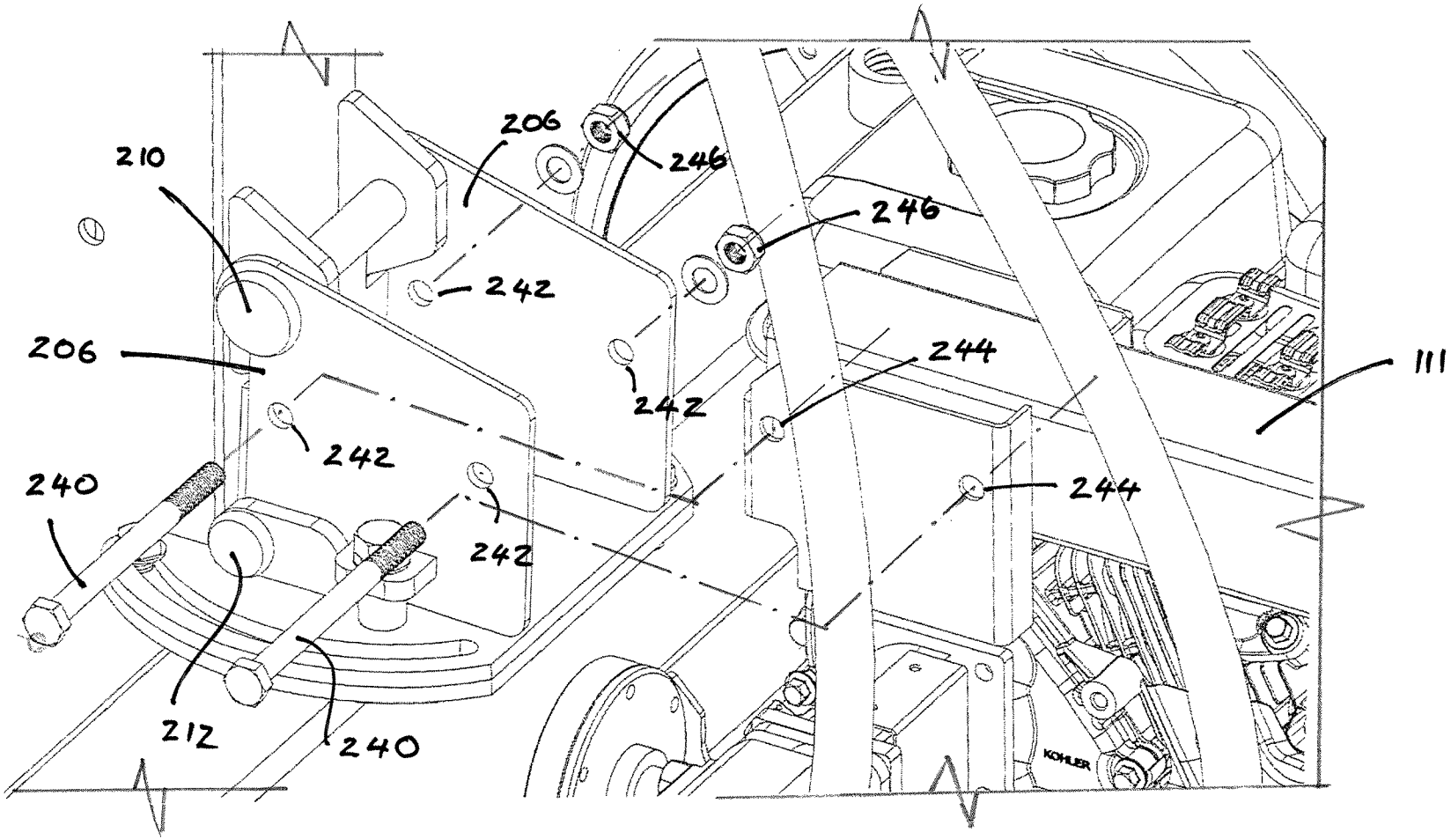
FIG. 11 is a detail view of the connector shown in FIG. 10.
Figure 16:
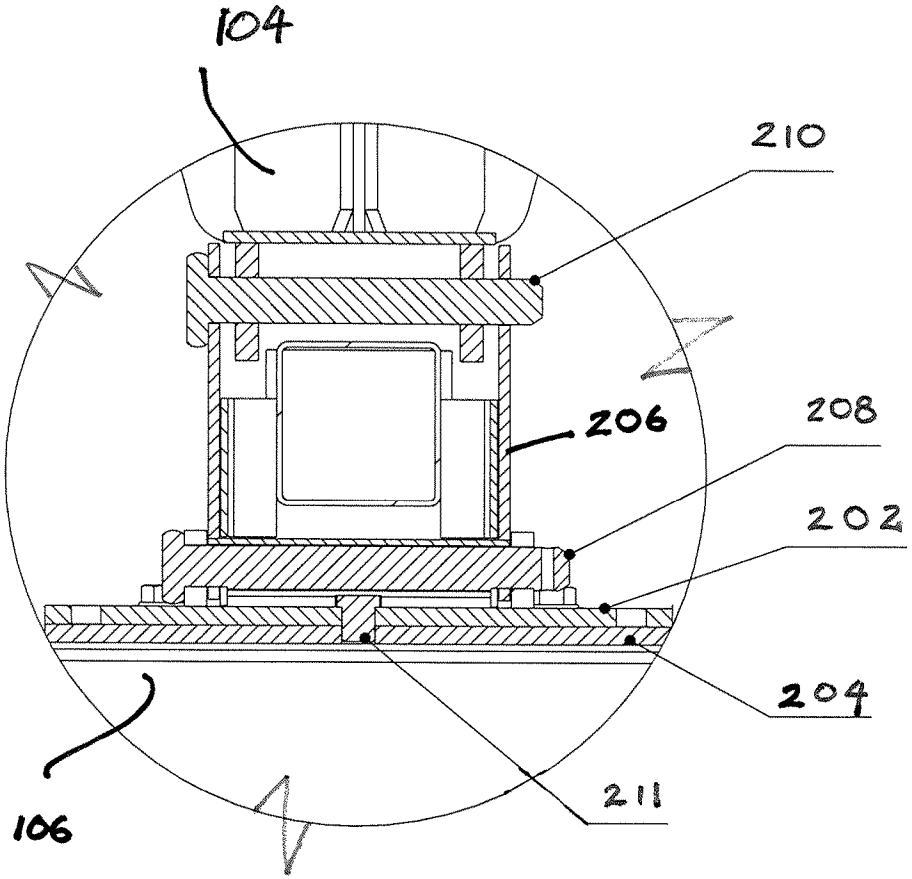
FIG. 16 is a vertical sectional view taken through the center of a connector seen in FIG. 15.

FIG. 3 shows details of a connector having features of the invention, the connector being configured to operably connect the first beam 104 to the second beam 106 in both a compact folded condition and an expanded unfolded condition of the log splitter. The connector comprises an upper pressure plate 202 positioned above and in bearing contact with a lower pressure plate 204. The lower pressure plate is connected to the lower beam 106, by weld or similar means. With reference to FIG. 16, which is a sectional view taken through the center of the pressure plates shown in FIG. 3, it is shown that a pin 211 passes through the upper pressure plate and lower pressure plate, enabling the two plates to rotate in a horizontal plane in relation to each other about the pin 211. The connector further comprises a shoulder plate 206 (matched by a second shoulder plate 206 not seen in FIG. 3, but seen for example in FIG. 11) which is configured to rotate in a vertical arc about a first axle 208 which is operably connected to an upper surface of the first pressure plate 202. The upper end of the shoulder plate is attached to the first beam 104 via a second axle 210, so that when the shoulder plate rotates about the first axle 208, the first beam 104 rotates about the second axle 210, and is able to maintain a horizontal orientation. Inadvertent rotation of the upper pressure plate about the pin 211 is prevented by at least two bolts 214, 216. (Two equivalent additional bolts may be provided on the opposite side of the pressure plates, but are not seen in the figures.) The two bolts are positioned at opposite ends of an arced slot 212 in the upper pressure plate 202, and pass through two separate holes 213 (not visible in FIG. 3 but see for example FIG. 7) in the lower pressure plate 204. When tightened, the bolts 214, 216 prevent movement of the pressure plates in relation to each other.

Figure 4:
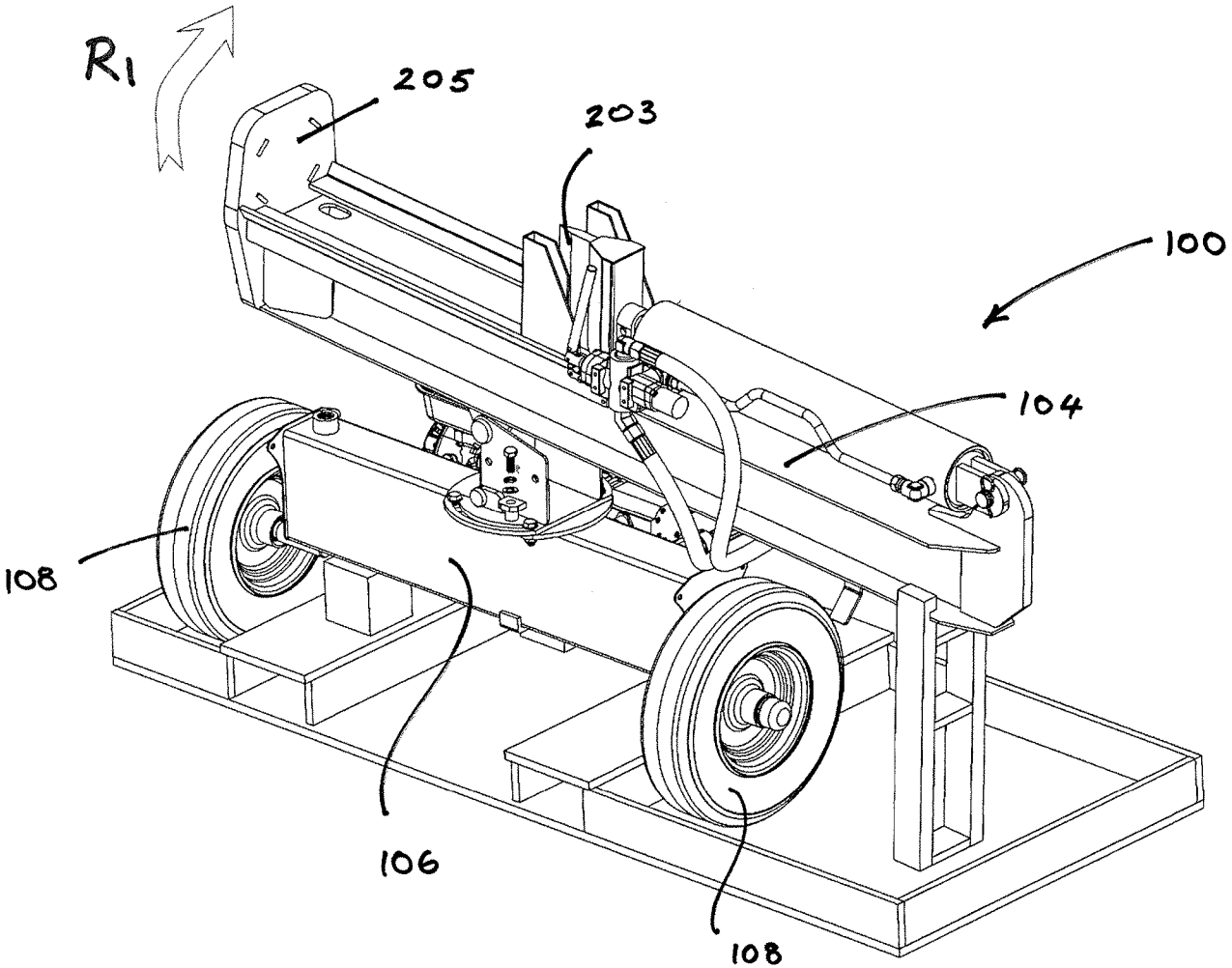
FIG. 4 is a perspective view of the log splitter in FIG. 2, shown in a second condition wherein an unfolding sequence is commenced.
Figure 5:
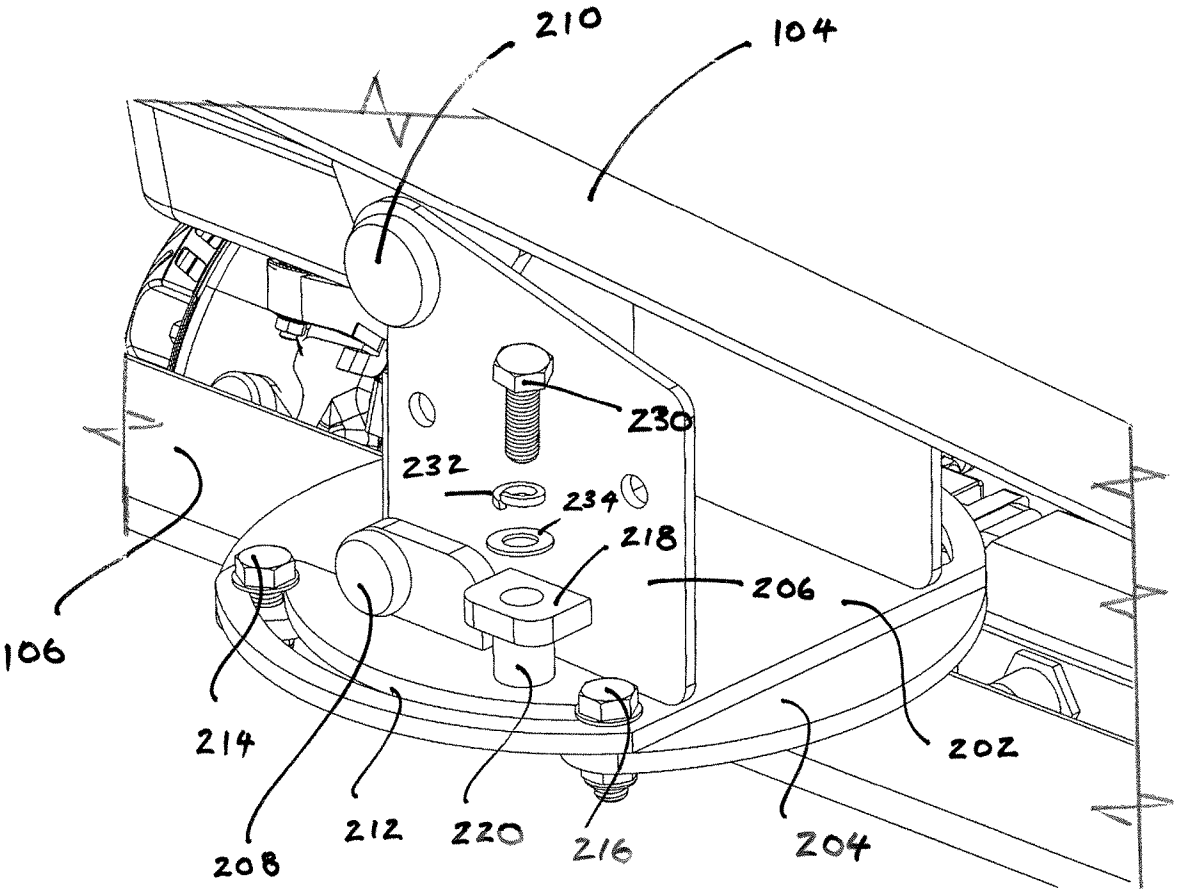
FIG. 5 is a detail view of the connector shown in FIG. 4.

In a first step towards preparing the splitter 100 for use, FIG. 4 and FIG. 5 show how the first beam 104 is lifted vertically upwards at one end (arrow R1) while at the same time the first beam 104 is slid a short distance, so that the shoulder plate 206 rotates about the first axle 208) and at the same time the upper beam 104 rotates about the second axle 210. This rotation of the shoulder plate brings a first holed flange 218 on the shoulder plate to be adjacent a second holed flange 220 on the upper pressure plate. A threaded screw 230 is passed through the first holed flange 218 and is screwed into the threaded second holed flange 220 with a lock-washer 232 and Teflon washer 234. This secures the shoulder plate against further rotation.

Figure 6:
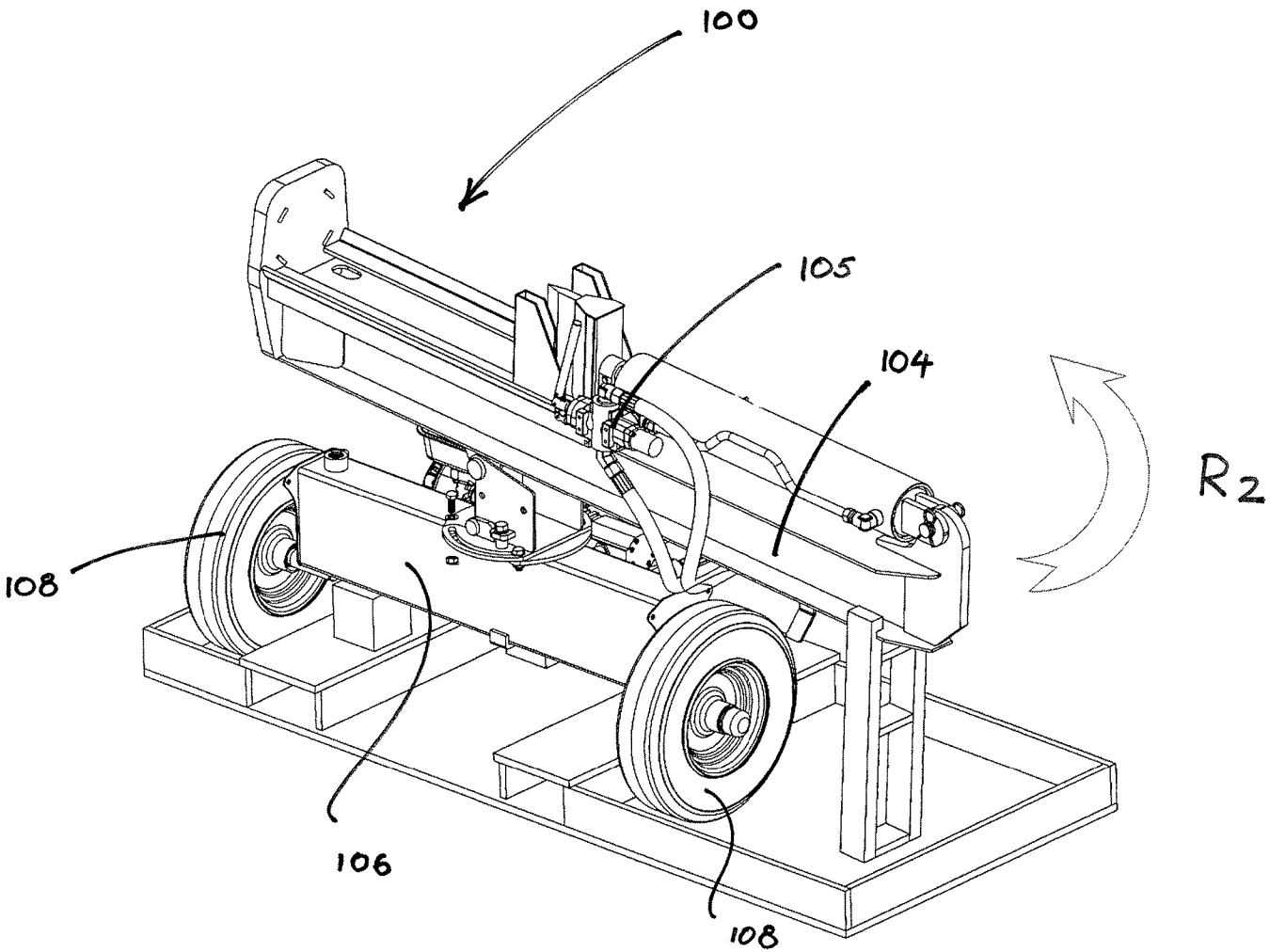
FIG. 6 is a perspective view of the log splitter in FIG. 5, shown in a third condition of an unfolding sequence.
Figure 7:
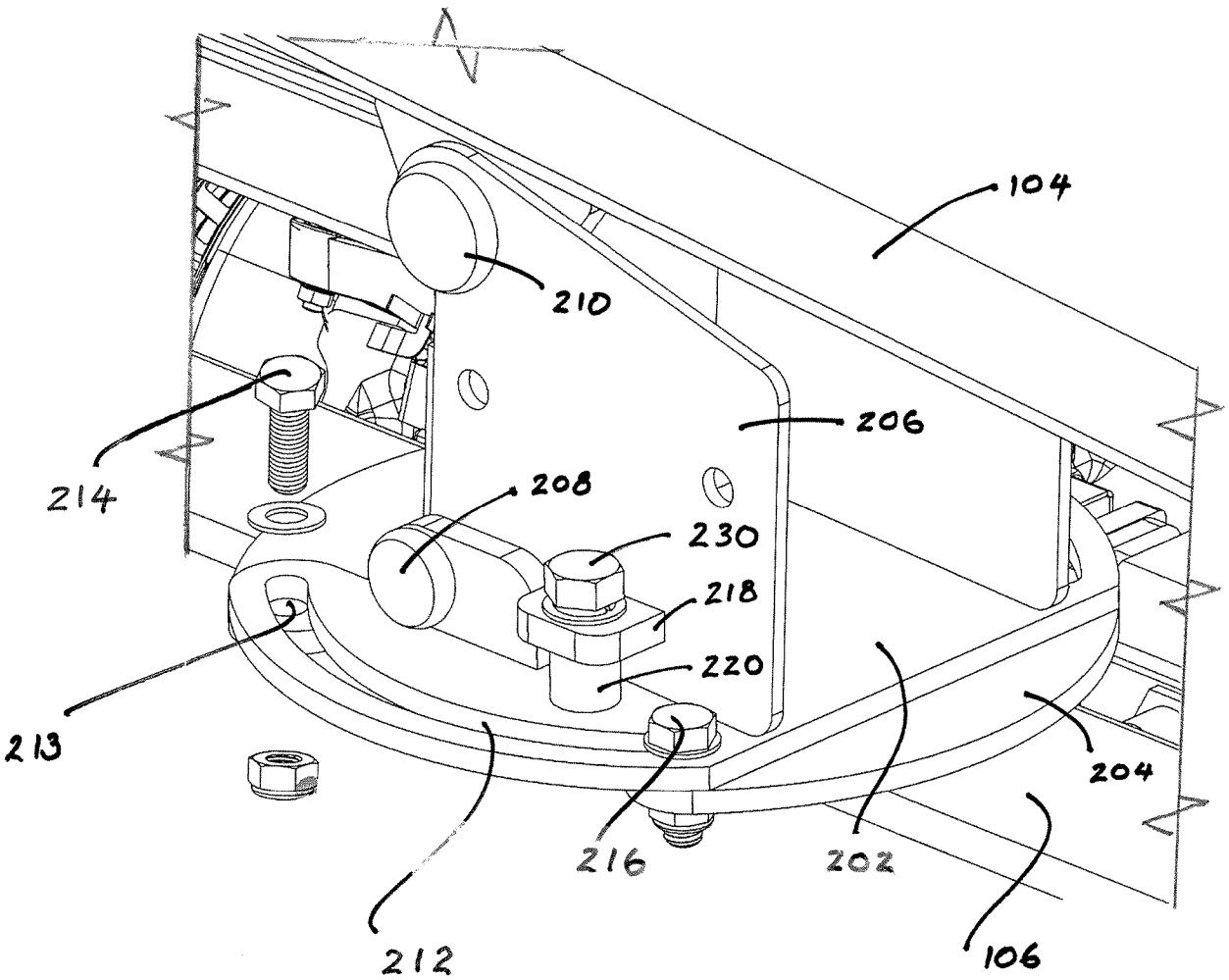
FIG. 7 is a detail view of the connector shown in FIG. 6.

In a further step towards preparing the splitter 100 for use, and with reference to FIG. 6 and FIG. 7, the first bolt 214 is removed from its secure location, and second bolt 216 is loosened somewhat. This action permits the first beam 104 to be rotated counterclockwise when viewed from above, by 90 degrees. (See arrow R2.) The second bolt 216 slides freely in the slot 212 until the end of the slot bumps up against the second bolt 216.

Figure 8:
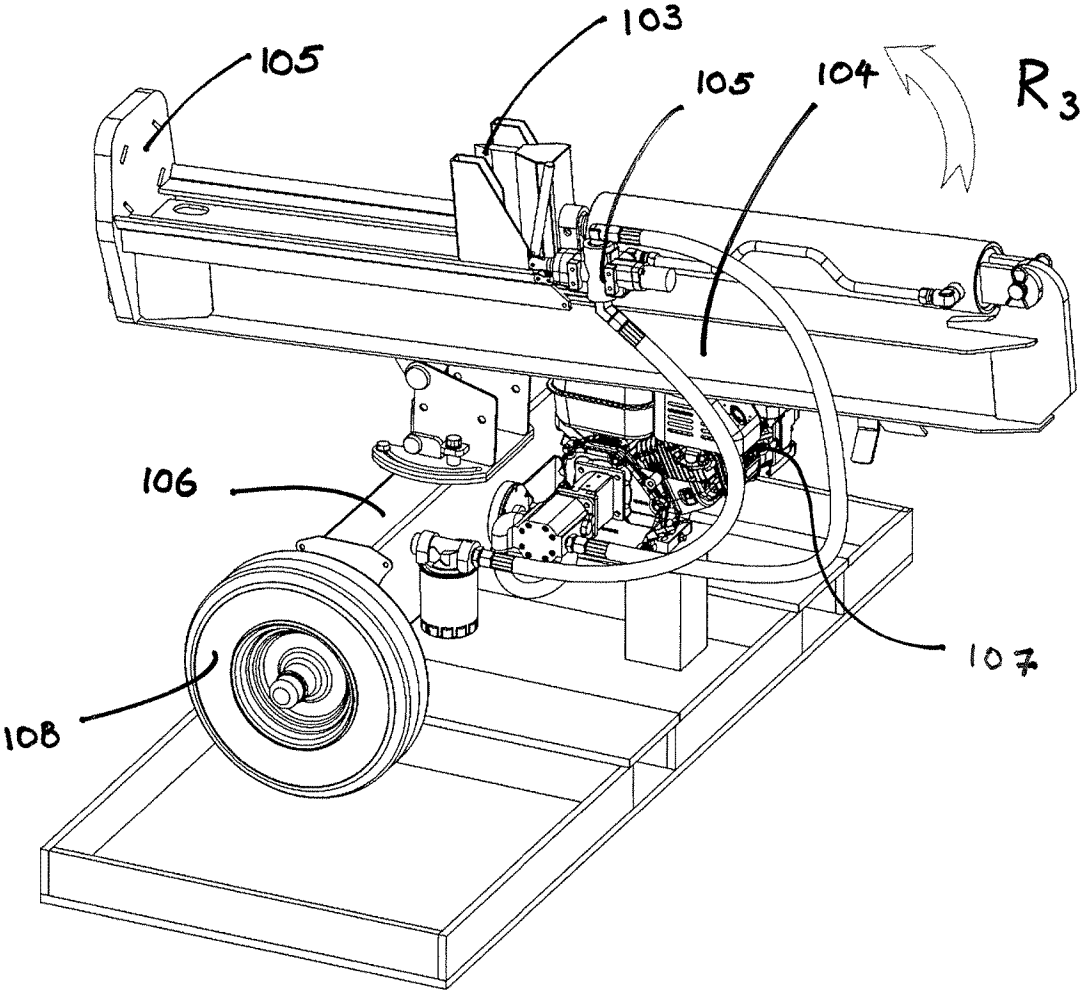
FIG. 8 is a perspective view of the log splitter in FIG. 6, shown in a fourth condition of an unfolding sequence.
Figure 9:
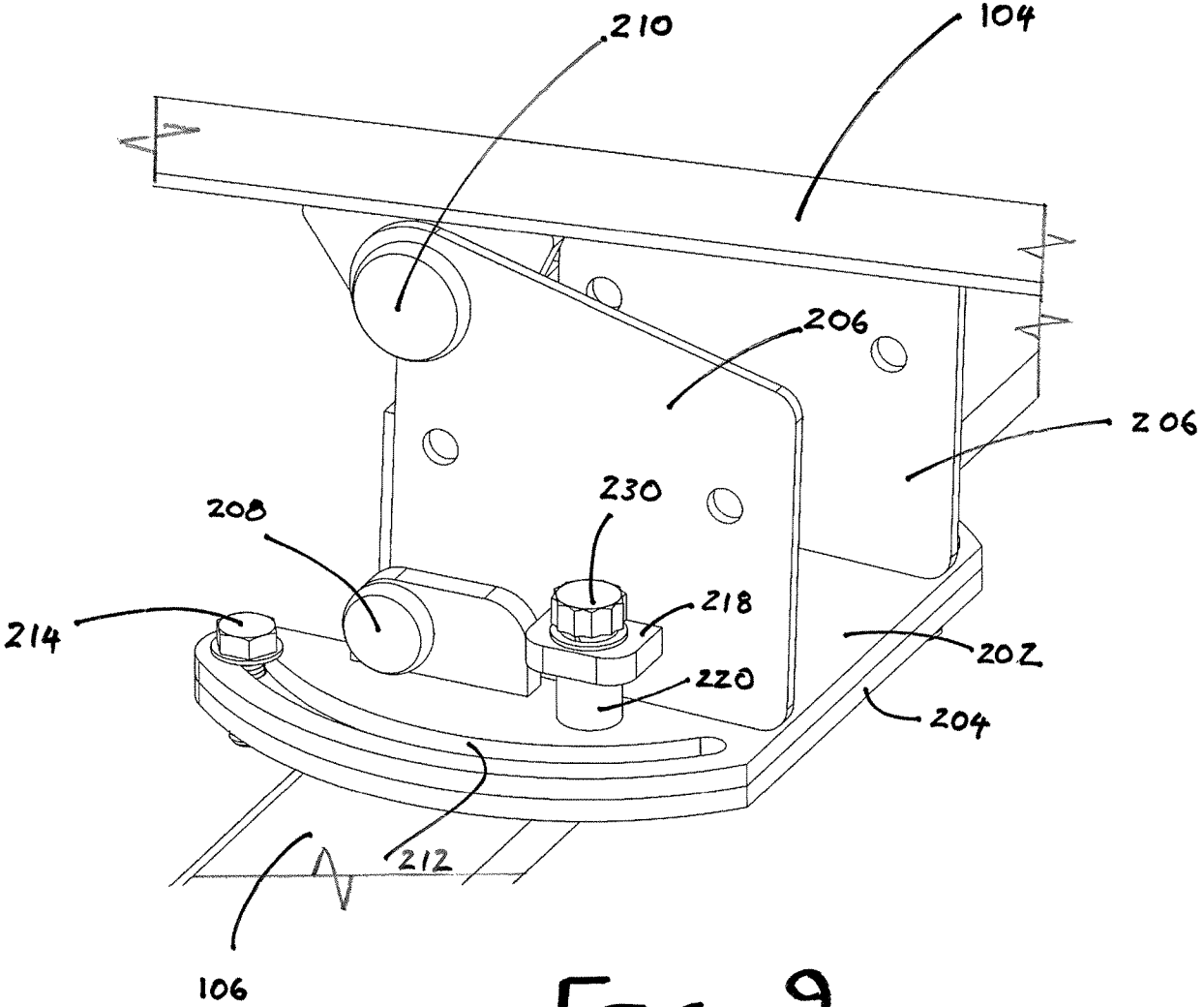
FIG. 9 is a detail view of the connector shown in FIG. 8.

At this point, the first beam 104 is oriented perpendicular to the second beam 106 as shown in FIG. 8 and FIG. 9.

Figure 10:
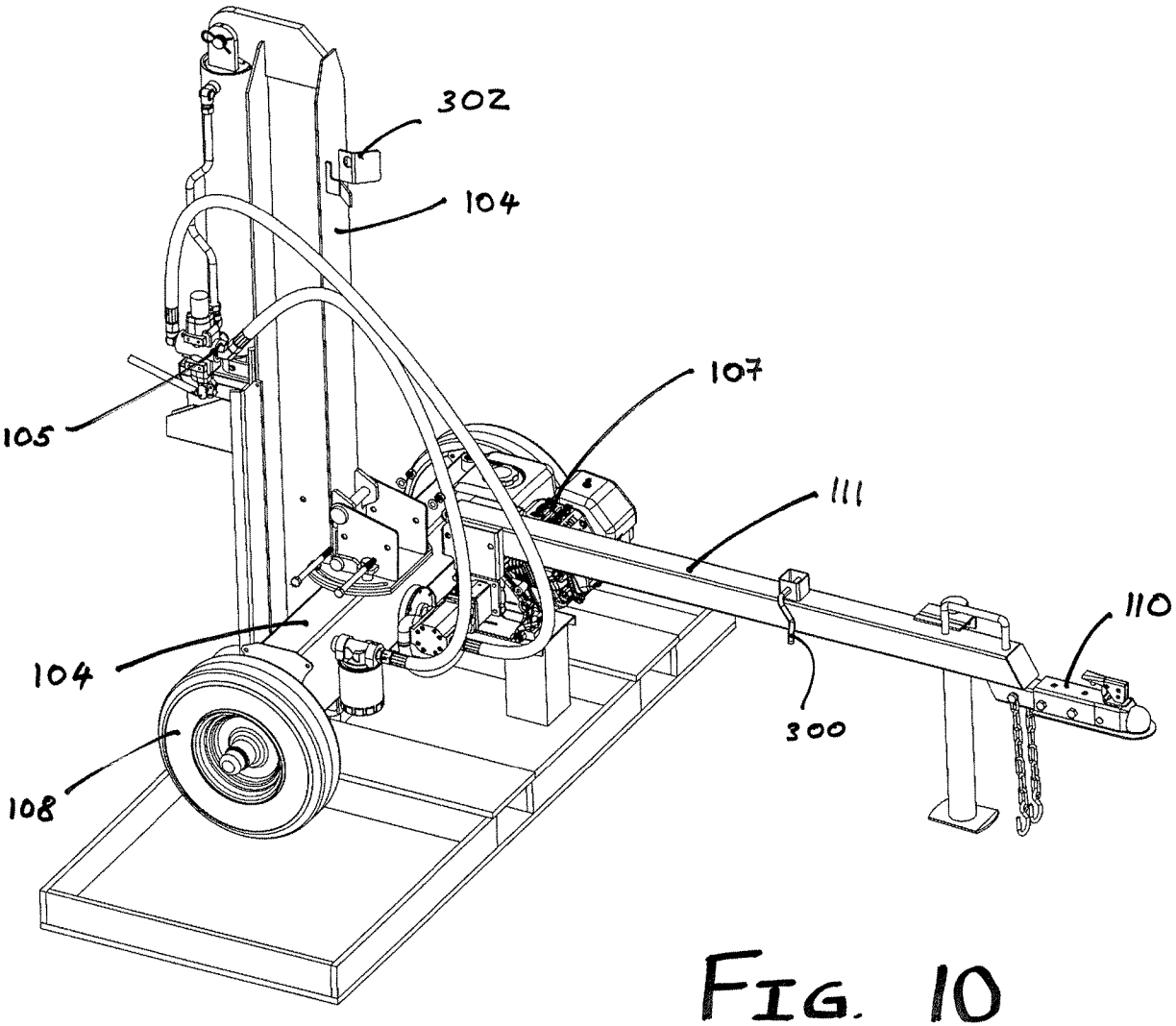
FIG. 10 is a perspective view of the log splitter in FIG. 8, shown in a fifth condition of an unfolding sequence.
Figure 12:
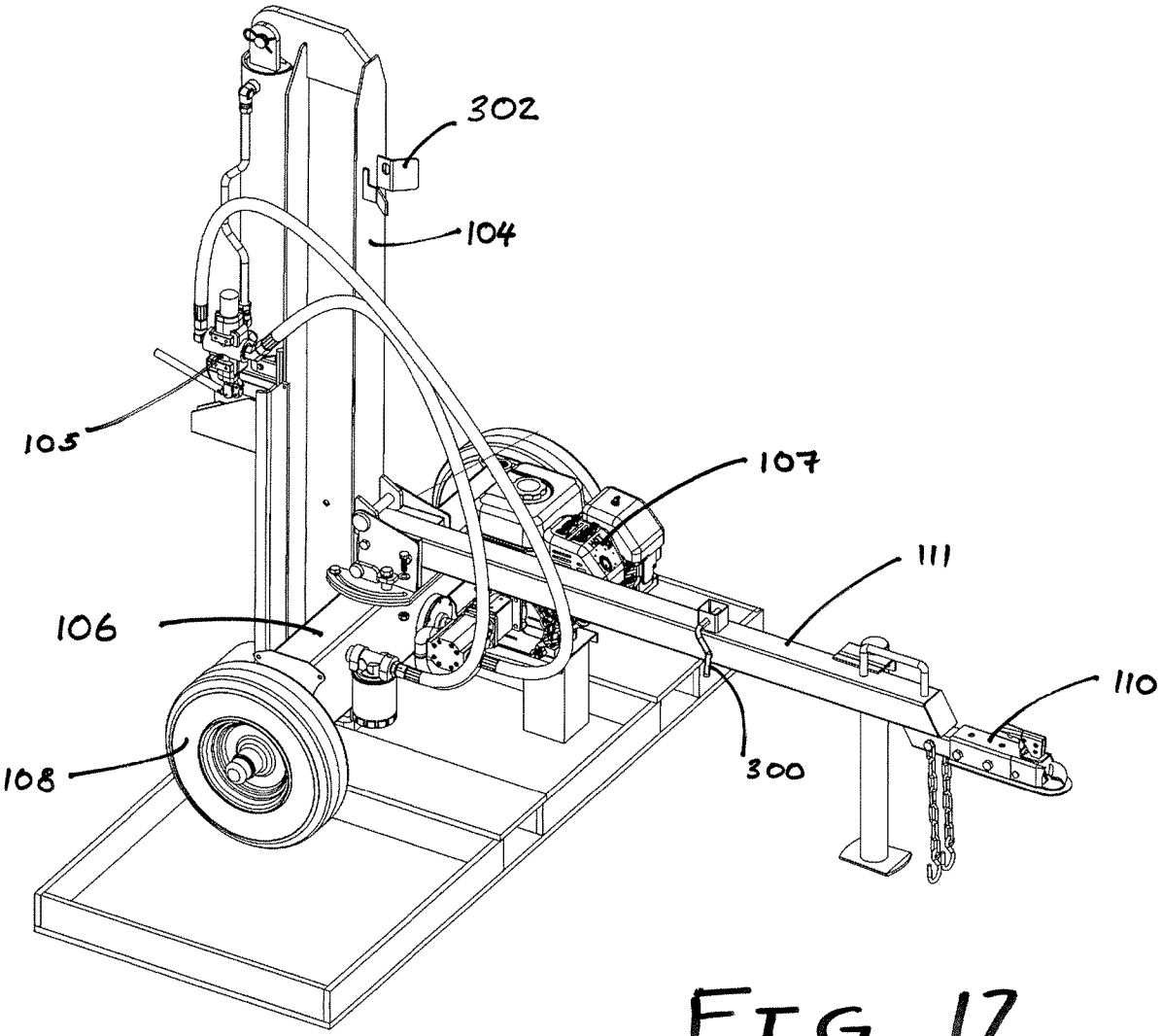
FIG. 12 is a perspective view of the log splitter in FIG. 10, shown in a sixth condition of an unfolding sequence.
Figure 13:
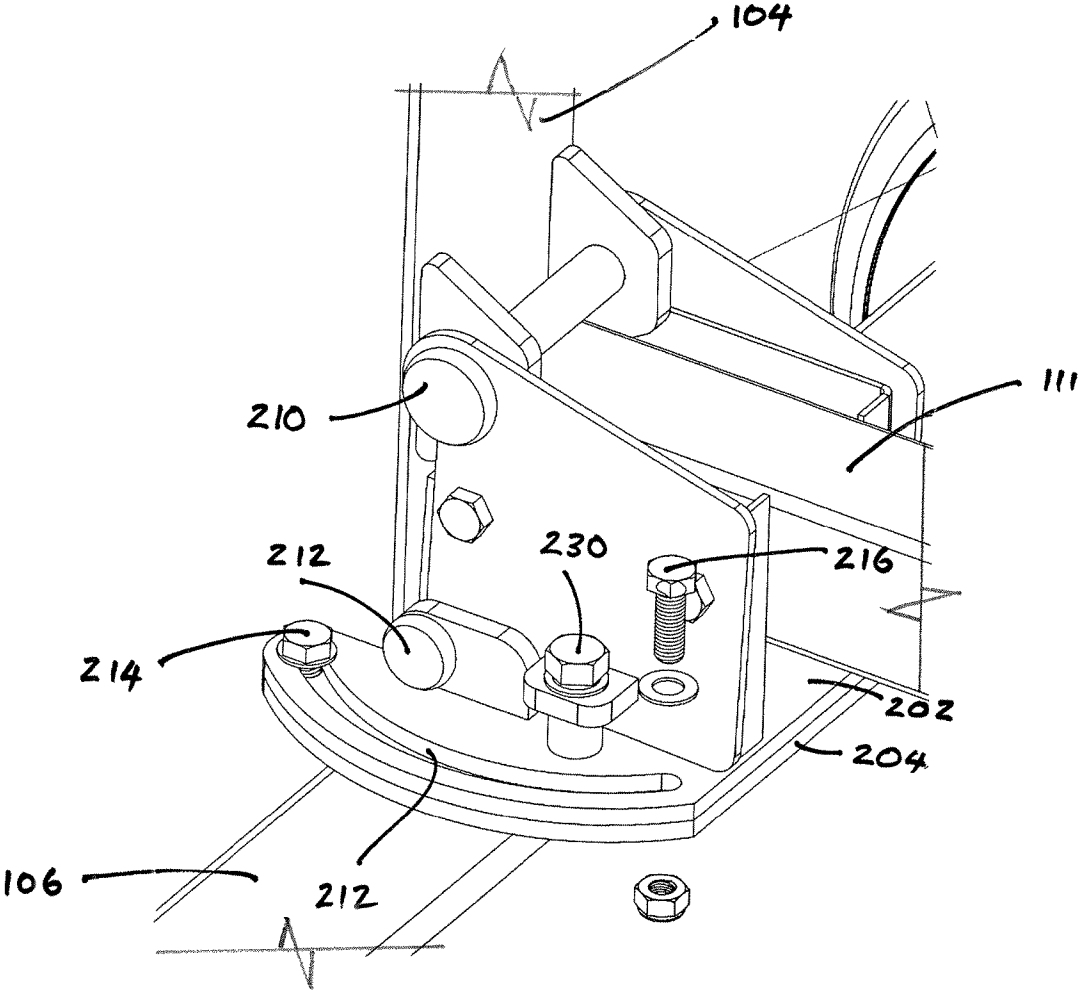
FIG. 13 is a detail view of the connector shown in FIG. 12.

Then, as shown in FIG. 10, the first beam 104 is rotated vertically (arrow R3 in FIG. 8) about the second axle 210 until the first beam 104 points substantially vertically up into the air. This action exposes the connector elements and allows the tow hitch 110 with its tow bar 111 to be brought into engagement between the two shoulder plates 206, as may be envisaged with reference to FIG. 11. Two bolts 240 are passed through two opposing holes 242 in the shoulder plates 206, and also through two holes 244 in the tow bar 111. The bolts 240 are secured with nuts 246 on opposite ends, and the tow hitch 110 and bar 111 are securely in place, as shown in FIG. 12 and FIG. 13. When this is complete, the second bolt is reinstalled through the slot 212 in the upper pressure plate 202. Thus, the two pressure plates 202, 204 are secured against horizontal rotation. A spring loaded bolt 300 positioned on the tow bar 111 is configured to pass through holes 302 positioned on the first beam 104. The bolt 300 may be manually removed from the holes 302 when desired, for example when it is desired to reverse the process of unpacking and unfolding for long term storage.

Figure 14:
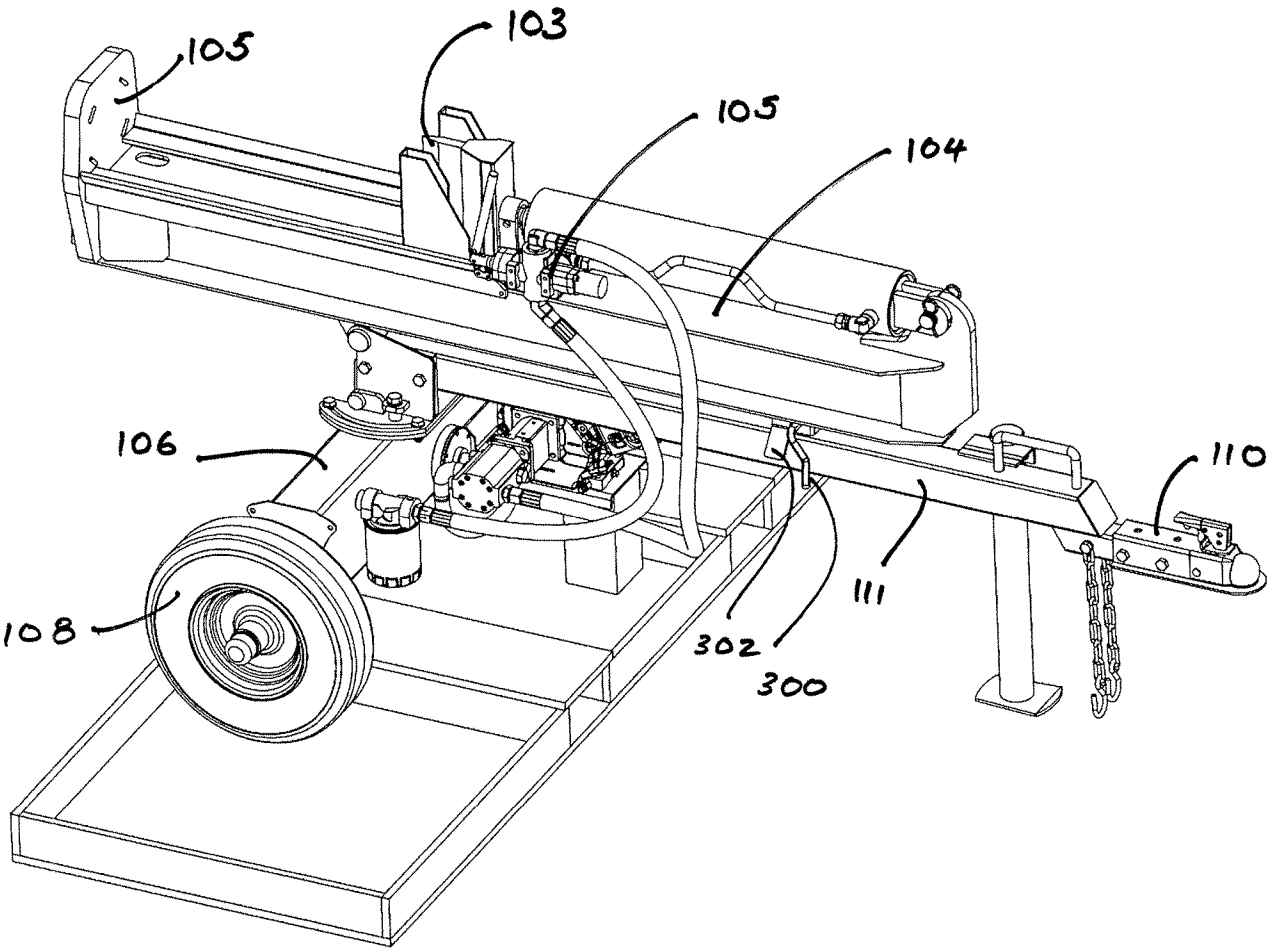
FIG. 14 is a perspective view of the log splitter in FIG. 11, shown in a seventh condition of an unfolding sequence.
Figure 15:
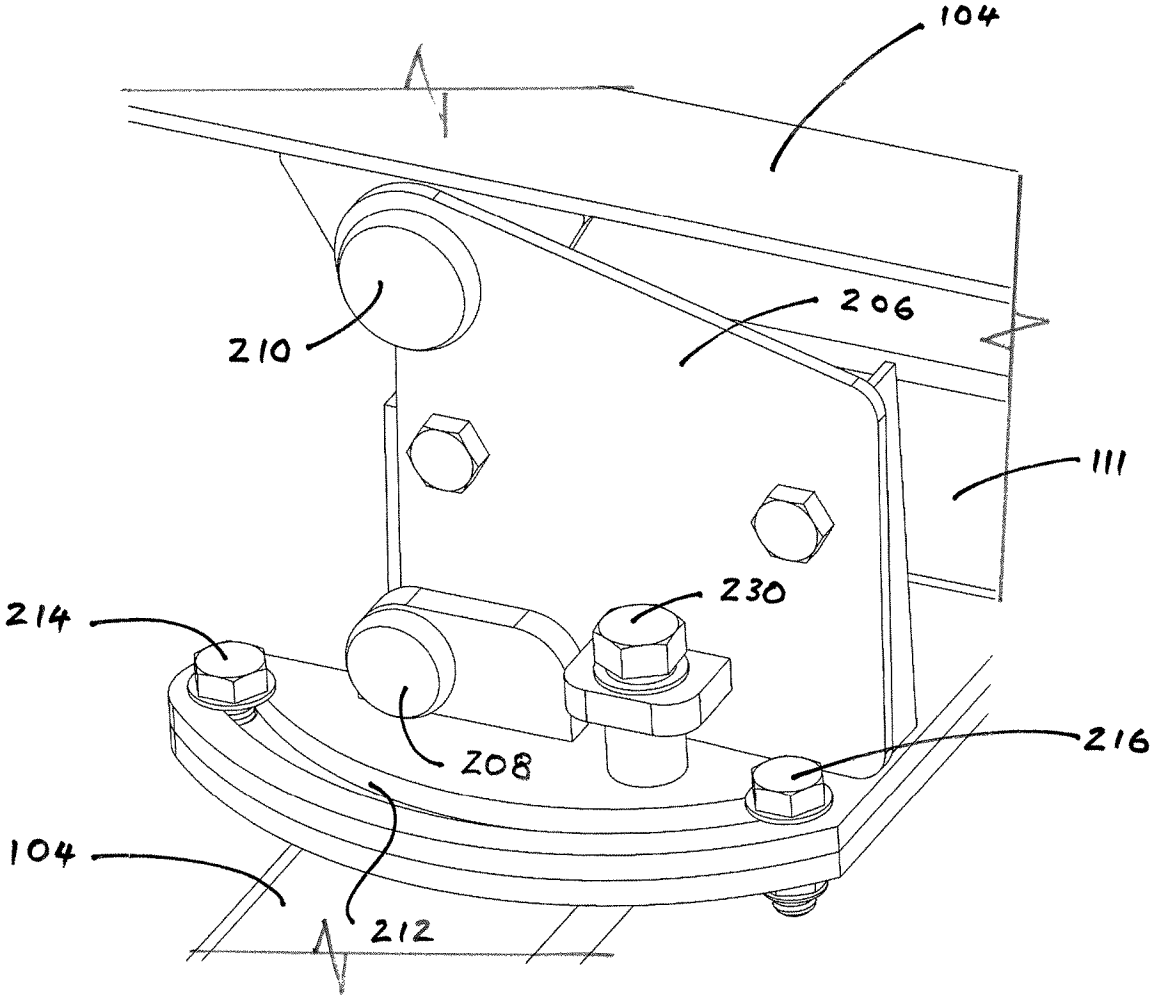
FIG. 15 is a detail view of the connector shown in FIG. 14.

At this point, the splitter 100 has the appearance as shown in FIG. 14 and FIG. 15. All bolts are in secure position, and the splitter is ready to be used. All components of the splitter are securely fastened. Not only can it be used for its intended purpose as a log splitter, but it may easily be connected to a tow hook on a towing vehicle and may be moved from place to place as desired. Most significantly, the assembler has not been obliged to connect any of the hoses 105 or the engine 107 to render the log splitter operable. He has also avoided having to lift heavy beams and parts to connect them together. Rather, the assembler takes just a few minutes to pivot and rotate major portions of the splitter about each other, and to insert and tighten a few bolts.

Accordingly, there is described a novel system and method that addresses needs in the art for packaging and unpackaging a log splitter. A log splitter is taken from a relatively compact condition packed in a crate, and is expanded into a final condition suitable for use as a log splitter. Pipes, hoses, and machinery are all assembled at the factory, so that the end user or distributor is not confronted with mechanical problems that may arise during final assembly after sale. The present invention may, of course, be carried out in other specific ways than those herein set forth without departing from the essential characteristics of the invention. The present embodiments are, therefore, to be considered in all respects as illustrative and not restrictive, while the scope of the invention is set forth in the claims that follow.

I claim:

1. A log splitter comprising:

a first beam supporting a moveable blade configured for splitting logs;

a second beam extending horizontally between two wheels;

a connector that connects the first beam to the second beam, the connector comprising:

an upper pressure plate operably connected to the first beam;

a lower pressure plate operably connected to the second beam;

a vertical pin passing through a hole in one of the upper pressure plate or lower pressure plate, the upper pressure plate being rotatable about the pin while being in contact with the lower pressure plate, at least one shoulder plate being rotatably connected about a first axle to the upper pressure plate, and being further rotatably connected about a second axle to the first beam, wherein:

the first beam is rotatable horizontally about the vertical pin between a first position being horizontal and parallel with the second beam, and a second position being horizontal and perpendicular to the second beam;

the first beam is moveable upwards, while connected via the shoulder plate to the second beam, from the second position which is a first distance from the second beam, to a third position being horizontal and a second distance from the second beam, the second distance being greater than the first distance; and the first beam is vertically rotatable about the second axle between the third position and a fourth position being vertically oriented and perpendicular to the second beam.

2. The log splitter of claim 1, wherein the upper pressure plate and lower pressure plate each define openings for a receiving a securing bolt for preventing horizontal rotation of the upper pressure plate in relation to the lower pressure plate.

3. The log splitter of claim 1, wherein the shoulder plate and the upper pressure plate each define openings for receiving a securing bolt for preventing vertical rotation of the shoulder plate in relation to the upper pressure plate.

4. The log splitter of claim 1, further including a tow bar, and wherein the shoulder plate and the tow bar each define at least one opening, wherein a bolt is inserted in each opening for connecting the tow bar to the shoulder plate.

* * * * *